US007722336B2

(12) United States Patent
Vaccarezza et al.

(10) Patent No.: US 7,722,336 B2
(45) Date of Patent: May 25, 2010

(54) COMPRESSOR WHEEL

(75) Inventors: Stephen E. Vaccarezza, Torrance, CA (US); Voytek Kanigowski, Fountain Valley, CA (US)

(73) Assignee: Honeywell International Inc., Morristown, NJ (US)

( * ) Notice: Subject to any disclaimer, the term of this patent is extended or adjusted under 35 U.S.C. 154(b) by 400 days.

(21) Appl. No.: 11/011,850

(22) Filed: Dec. 14, 2004

(65) Prior Publication Data

US 2006/0127243 A1 Jun. 15, 2006

(51) Int. Cl.
*F04B 17/00* (2006.01)
*F04B 35/00* (2006.01)

(52) U.S. Cl. ..... 417/407; 417/53; 416/204 R; 416/244 R

(58) Field of Classification Search ..... 417/407, 417/53; 416/183, 204 R, 244 R; 415/230
See application file for complete search history.

(56) References Cited

U.S. PATENT DOCUMENTS

| | | | | |
|---|---|---|---|---|
| 3,601,501 | A * | 8/1971 | Johnson et al. | 416/244 R |
| 5,176,497 | A * | 1/1993 | Deacon et al. | 415/230 |
| 6,499,969 | B1 * | 12/2002 | Tombers et al. | 417/407 |
| 2005/0042105 | A1 * | 2/2005 | Nishiyama et al. | 416/183 |

FOREIGN PATENT DOCUMENTS

| | | | |
|---|---|---|---|
| DE | 29702119 | U1 | 4/1997 |
| GB | 2091308 | A | 7/1982 |

* cited by examiner

*Primary Examiner*—Devon C Kramer
*Assistant Examiner*—Peter J Bertheaud
(74) *Attorney, Agent, or Firm*—Brian Pangule

(57) ABSTRACT

An exemplary compressor wheel includes a proximate end, a distal end, an axis of rotation, a z-plane positioned between the proximate end and the distal end and a proximate end extension wherein the extension includes one or more pilot diameters and an engagement mechanism for engagement with an operational shaft of a turbocharger.

11 Claims, 7 Drawing Sheets

COMPRESSOR WHEEL

TECHNICAL FIELD

Subject matter disclosed herein relates generally to methods, devices, and/or systems for compressors and, in particular, compressors for internal combustion engines.

BACKGROUND

Various types of joints exist for connecting a compressor wheel to a shaft. Some joints rely on a bore in the compressor wheel along the axis of rotation. In such joints, a shaft passes through the bore and a nut secures the wheel to the shaft. Other joints rely on a "boreless" compressor wheel. A boreless compressor wheel includes a joint or chamber that extends a distance into the compressor wheel where the distance along the rotational axis typically does not extend to or beyond the z-plane of the compressor wheel.

In either instance, the bore or joint must be formed or machined into the compressor wheel. Stresses introduced by such processes may compromise wheel integrity such that a wheel fails during operation. Yet further, if one chooses to use titanium or other hard material for a compressor wheel, machining of a joint can be time and resource intensive.

Another concern pertains to balancing a compressor wheel. Boreless compressor wheels pose unique challenges for balancing. Compressor wheels may be component balanced using a balancing spindle and/or assembly balanced using a compressor or turbocharger shaft. Each approach has certain advantages, for example, component balancing allows for rejection of a compressor wheel prior to further compressor or turbocharger assembly; whereas, assembly balancing can result in a better performing compressor wheel and shaft assembly.

For conventional boreless compressor wheels, balancing limitations arise due to aspects of the boreless design. In particular, conventional boreless compressor wheels require shallow shaft attachment joints (e.g., typically not extending to or beyond the z-plane) to minimize operational stress. Such shallow joints can introduce severe manufacturing constraints. To overcome such constraints and/or other issues, a need exists for a new compressor wheel joint. Accordingly, various exemplary joints, compressor wheels, balancing spindles, assemblies and methods are presented herein that aim to meet aforementioned needs and/or other needs.

BRIEF DESCRIPTION OF THE DRAWINGS

A more complete understanding of the various method, devices, systems, etc., described herein, and equivalents thereof, may be had by reference to the following detailed description when taken in conjunction with the accompanying drawings wherein.

DETAILED DESCRIPTION

Various exemplary devices, systems, methods, etc., disclosed herein address issues related to compressors. An overview of turbocharger operation is presented below followed by a description of conventional compressor wheel joints, exemplary compressor wheel joints and an exemplary method of compressor wheel balancing.

Figure 1:
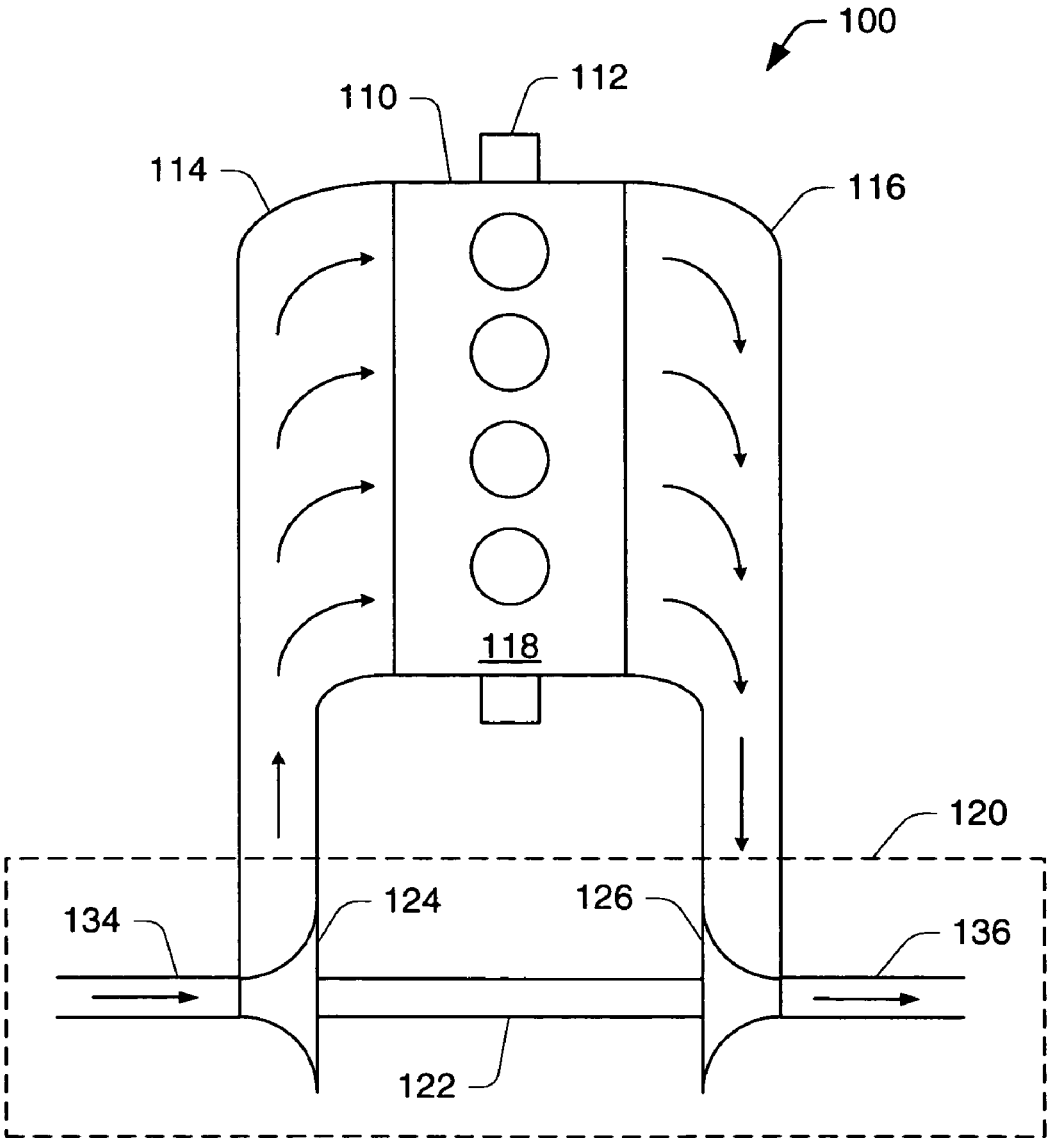
FIG. 1 is a simplified approximate diagram illustrating a turbocharger with a variable geometry mechanism and an internal combustion engine.

Turbochargers are frequently utilized to increase the output of an internal combustion engine. Referring to FIG. 1, an exemplary system 100, including an exemplary internal combustion engine 110 and an exemplary turbocharger 120, is shown. The internal combustion engine 110 includes an engine block 118 housing one or more combustion chambers that operatively drive a shaft 112. As shown in FIG. 1, an intake port 114 provides a flow path for air to the engine block while an exhaust port 116 provides a flow path for exhaust from the engine block 118.

The exemplary turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, and an exhaust outlet 136. A wastegate or other mechanism may be used in conjunction with such a system to effect or to control operation.

The turbine 126 optionally includes a variable geometry unit and a variable geometry controller. The variable geometry unit and variable geometry controller optionally include features such as those associated with commercially available variable geometry turbochargers (VGTs), such as, but not limited to, the GARRETT® VNT™ and AVNT™ turbochargers, which use multiple adjustable vanes to control the flow of exhaust across a turbine.

Figure 2:
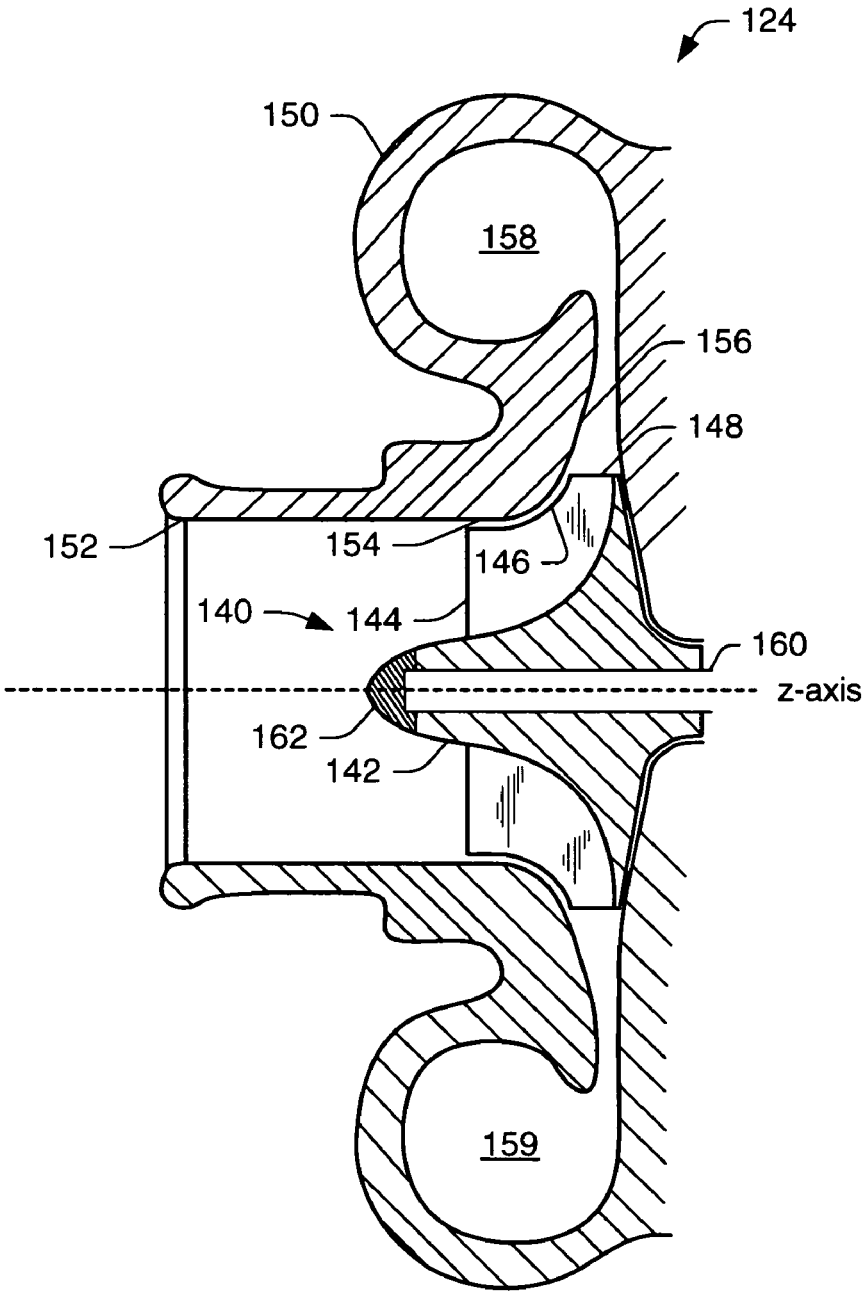
Fig.2 (Prior Art)
FIG. 2 is a cross-sectional view of a prior art compressor assembly that includes a compressor shroud and a compressor wheel having a full bore.

FIG. 2 shows a cross-sectional view of a typical prior art compressor assembly 124 suitable for use in the turbocharger system 120 of FIG. 1. The compressor assembly 124 includes a housing 150 for shrouding a compressor wheel 140. The compressor wheel 140 includes a rotor 142 that rotates about a central axis (e.g., a rotational axis). A bore 160 extends the entire length of the central axis of the rotor 142 (e.g., an axial rotor length); therefore, such a rotor is referred to at times as a full-bore rotor. An end piece 162 fits onto an upstream end of the rotor 142 and may act to secure a shaft and/or to reduce disturbances in air flow. In general, such a shaft has a compressor end and a turbine end wherein the turbine end attaches to a turbine capable of being driven by an exhaust stream.

Referring again to the compressor wheel 140, attached to the rotor 142, are a plurality of compressor wheel blades 144, which extend radially from a surface of the rotor. As shown, the compressor wheel blade 144 has a leading edge portion 144 proximate to a compressor inlet opening 152, an outer edge portion 146 proximate to a shroud wall 154 and a trailing edge portion 148 proximate to a compressor housing diffuser 156. The shroud wall 154, proximate to the compressor wheel blade 144, defines a section sometimes referred to herein as a shroud of compressor volute housing 150. The compressor housing shroud wall after the wheel outlet 156 forms part of a compressor diffuser that further diffuses the flow and increases the static pressure. A housing scroll 158, 159 acts to collect and direct compressed air.

Some symmetry exists between the upper portion of the housing scroll 158 and the lower portion of the housing scroll 159. In general, one portion has a smaller cross-sectional area than the other portion; thus, substantial differences may exist between the upper portion 158 and the lower portion 159. FIG. 2 does not intend to show all possible variations in scroll cross-sections, but rather, it intends to show how a compressor wheel may be positioned with respect to a compressor wheel housing.

Figure 3:
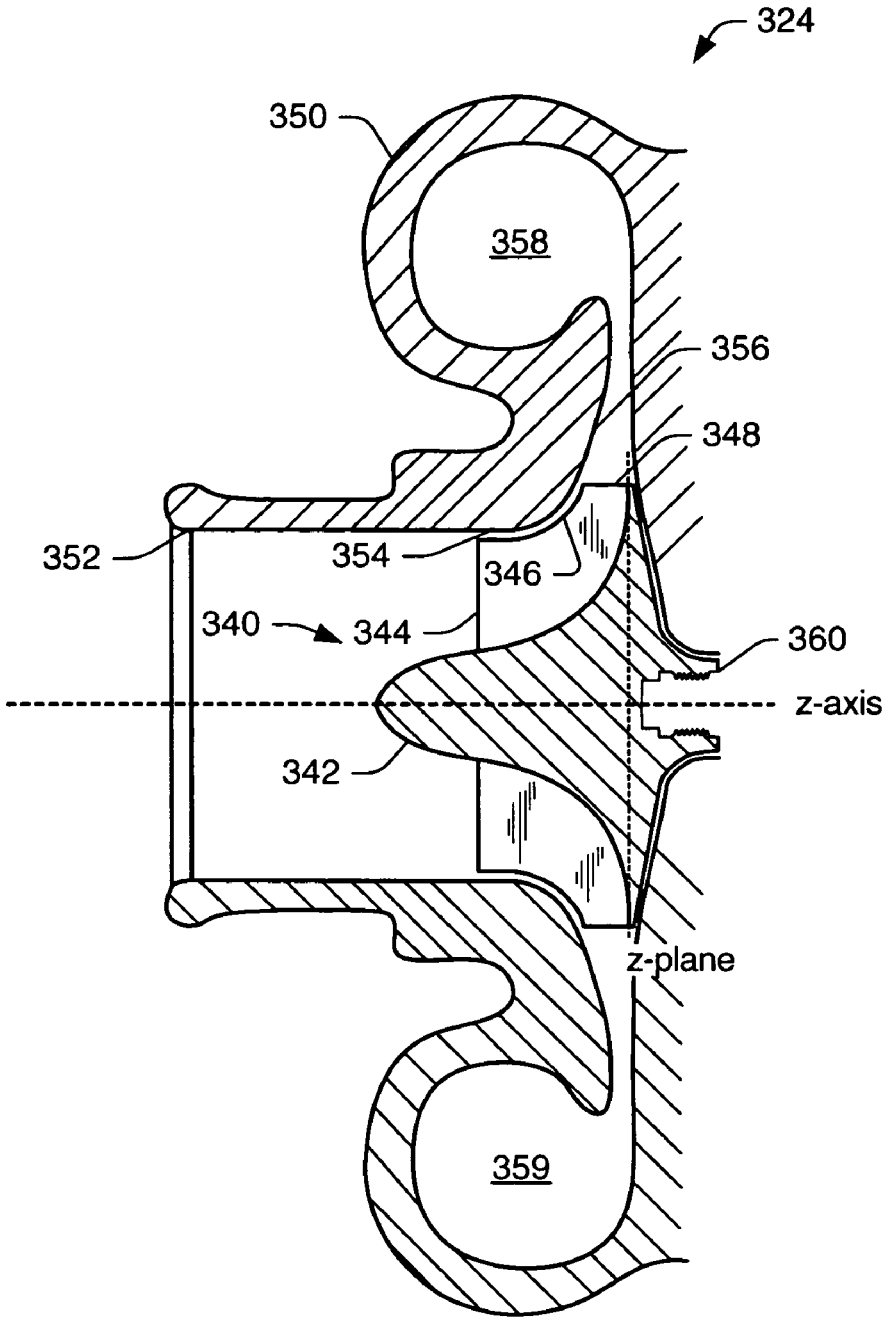
Fig.3 (Prior Art)
FIG. 3 is a cross-sectional View of a prior art compressor assembly that includes a compressor shroud and a conventional "boreless" compressor wheel.

FIG. 3 shows a cross-sectional view of a conventional prior art compressor wheel rotor 324 that includes a "boreless" compressor wheel 340 suitable for use in the turbocharger system 120 of FIG. 1. The compressor assembly 324 includes a housing 350 for shrouding a compressor wheel 340. The compressor wheel 340 includes a rotor 342 that rotates about a central axis. Attached to the rotor 342, are a plurality of compressor wheel blades 344, which extend radially from a surface of the rotor. As shown, the compressor wheel blade 344 has a leading edge portion 344 proximate to a compressor inlet opening 352, an outer edge portion 346 proximate to a shroud wall 354 and a trailing edge portion 348 proximate to a compressor housing diffuser 356. The shroud wall 354, proximate to the compressor wheel blade 344, defines a section sometimes referred to herein as a shroud of compressor volute housing 350. The compressor housing shroud wall after the wheel outlet 356 forms part of a compressor diffuser that further diffuses the flow and increases the static pressure. A housing scroll 358, 359 acts to collect and direct compressed air.

FIG. 3 shows a z-plane as coinciding substantially with a lowermost point of an outer edge or trailing edge portion 348 of the blade 344. A bore or joint 360 centered substantially on a rotor axis exists at a proximate end of the rotor 342 for receiving a shaft. Throughout this disclosure, the bore or joint 360 is, for example, a place at which two or more things are joined (e.g., a compressor wheel and a shaft or a spindle, etc.). Compressor wheels having a joint such as the joint 360 are sometimes referred to as "boreless" compressor wheels in that the joint does not pass or extend through the entire length of the compressor wheel. Indeed, such conventional boreless compressor wheels do not have joints that extend to the depth of the z-plane. The joint 360 typically receives a shaft that has a compressor end and a turbine end wherein the turbine end attaches to a turbine capable of being driven by an exhaust stream. For purposes of compressor wheel balancing, the joint 360 may receive a balancing spindle; however, such a balancing spindle cannot extend to or beyond the z-plane because of the joint depth. As discussed below with respect to FIG. 4, an important parameter in machining such a joint pertains to the distance between the z-plane and the end of the joint.

Figure 4:
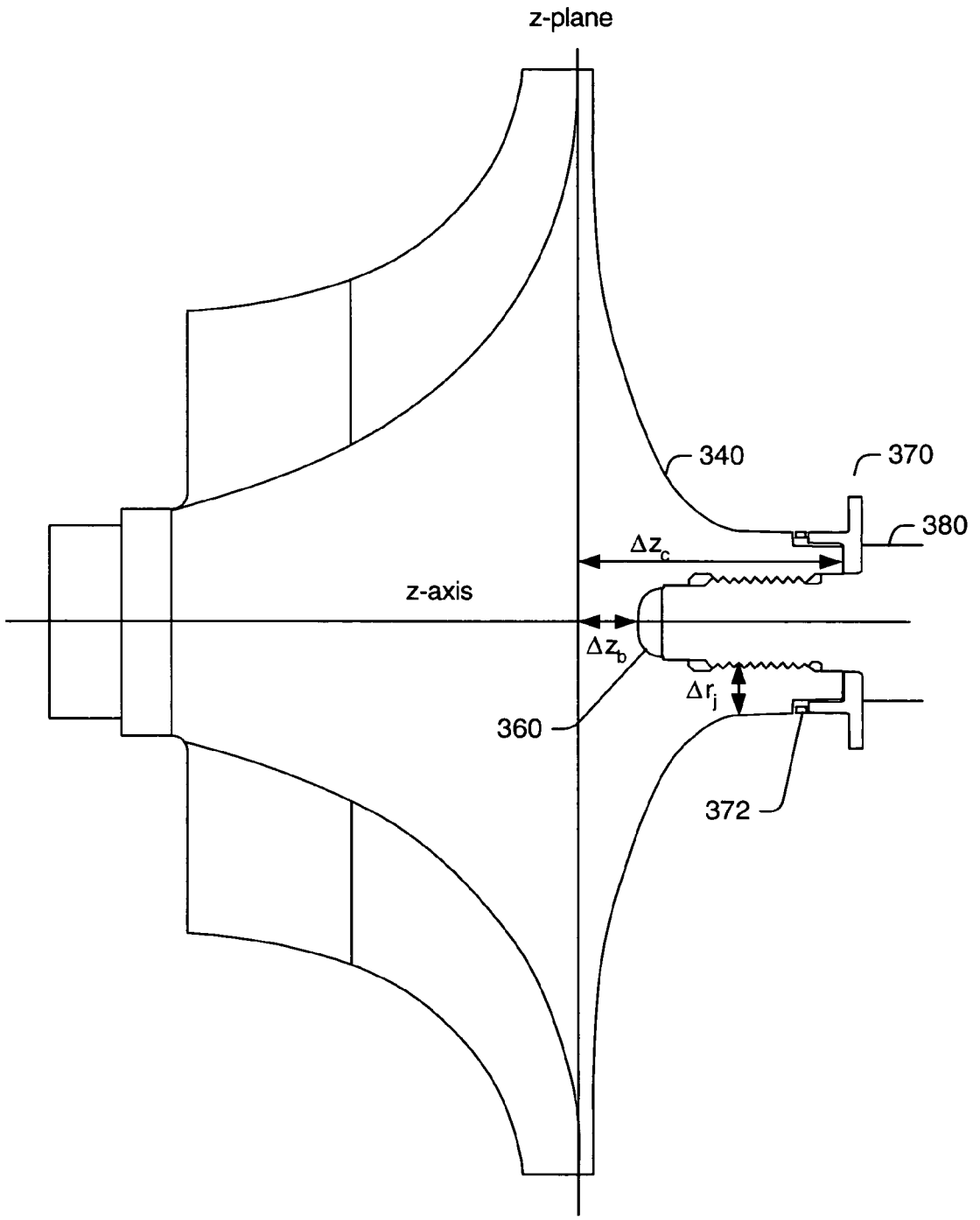
Fig.4 (Prior Art)
FIG. 4 is a cross-sectional view of a prior art compressor wheel assembly that includes a shaft and other components.

FIG. 4 shows a cross-sectional view of a prior art compressor wheel assembly that includes a compressor wheel 340, a thrust collar 370, a ring 372 and a shaft 380. The compressor wheel 340 includes a joint 360 $\Delta z_b$ indicates a distance between the end of the joint 360 and the z-plane. In the prior art compressor wheel 340, a maximum in stress occurs at or near the end of the joint 360 and along the z-axis. Integrity of the wheel 360 typically decreases as the distance $\Delta z_b$ diminishes; thus, the position of the end surface of the joint 360 must be carefully manufactured with respect to the z-plane of the wheel 340 and with respect to surface imperfections.

FIG. 4 shows another distance $\Delta z_c$, which represents an overhang distance as measured from the z-plane to the end surface of the wheel 340 where, for example, the wheel meets the thrust collar 370. The overhang distance or length can affect stability and, in general, a short overhang results in greater stability (e.g., bearing stability, rotordynamic stability, etc.). The conventional boreless wheel 340 also includes a radial distance $\Delta r_j$ along the joint length that may vary with respect to axial position. Such a distance may be used to calculate an overhang volume and, hence, an overhang mass. Overhang properties such as mass and extended distance from the z-plane may be used to determine stability.

A typical compressor wheel and shaft assembly includes a thrust collar that forms a portion of a thrust bearing assembly. Such an assembly may include a thrust spacer sleeve, a ring and/or other components. A thrust space sleeve is typically threaded onto a shaft to axially bearing engagement with a shoulder, such as a thrust collar or the like, forming a portion of the thrust bearing assembly and being rotatable with the shaft. In this manner, the sleeve spaces the compressor wheel axially relative to the thrust collar. In addition, the sleeve advantageously receives seal rings in its outer diameter grooves where the seal rings engage the inner diameter surface of the backplate wall shaft opening to prevent lubricant passage from the center housing into the compressor housing. As shown in FIG. 4, a ring 372 is positioned between the thrust collar 370 and the compressor wheel 340. While a ring is shown in FIG. 4, a carbon seal, labyrinth seal or other mechanism may be used.

Figure 5:
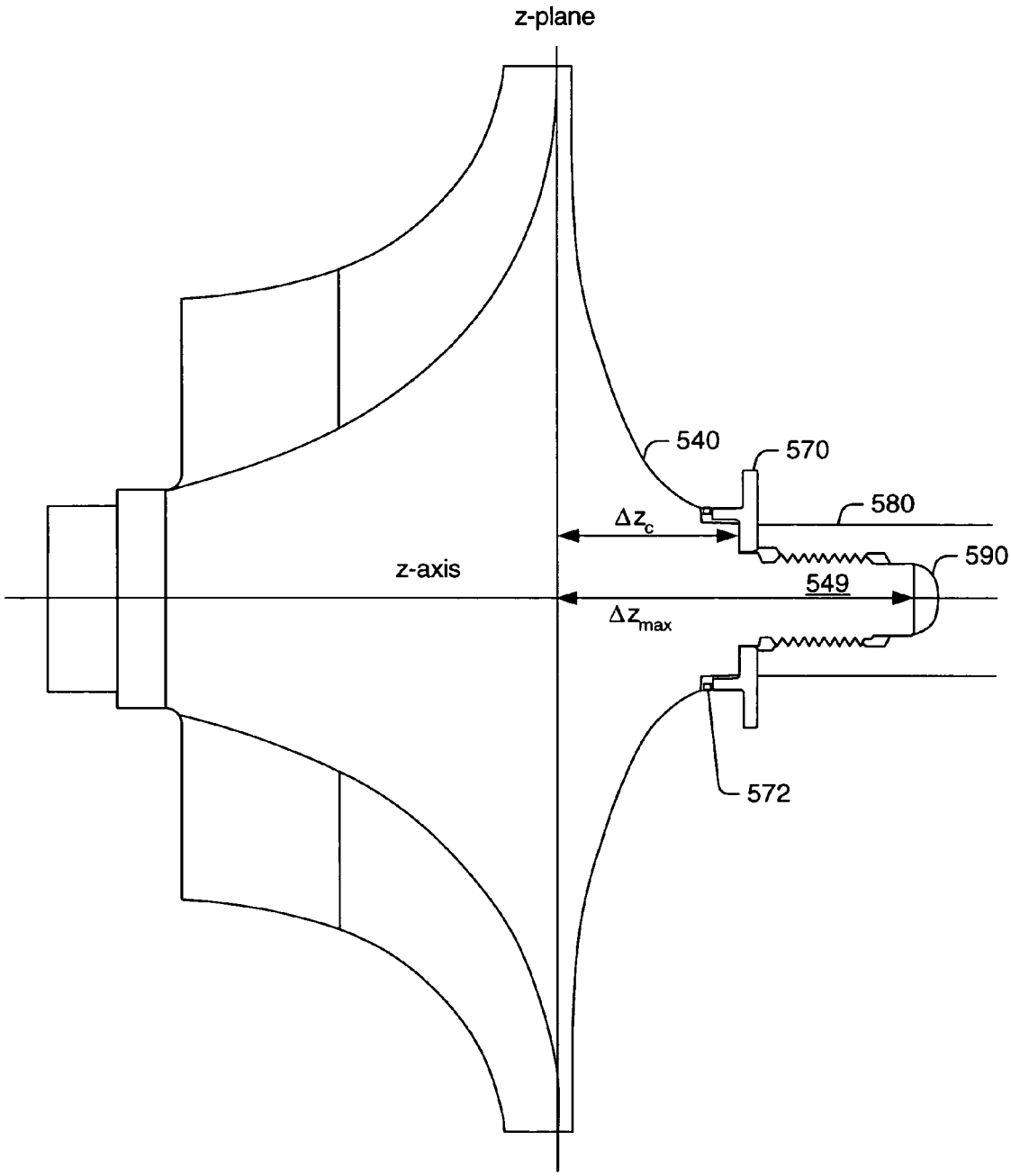
FIG. 5 is a cross-sectional view of an exemplary compressor wheel assembly that includes an exemplary shaft and other components.

FIG. 5 shows a cross-sectional view of an exemplary compressor wheel assembly that includes a compressor wheel 540, a thrust collar 570, a ring 572 and a shaft 580. The exemplary compressor wheel 540 includes an extension 549 for insertion in a joint 590 of the exemplary shaft 580. In this example, the extension 549 extends a distance $\Delta z_{max}$ along the z-axis from the z-plane. The exemplary wheel 540 includes a thrust collar distance $\Delta z_c$ from the z-plane to a surface that, for example, meets the thrust collar 570. The ring 572 may be positioned between a surface of the compressor wheel 540 and a surface of the thrust collar 570. As shown, the exemplary compressor wheel 540 includes a substantially annular surface at a distance of $\Delta z_c$ from the z-plane and in a plane substantially normal to the axis of rotation. This surface may act to seat the thrust collar 570. A notch or other surface may confine the ring 572 between the thrust collar 570 and the wheel 540.

Various exemplary wheels include a distance from the z-plane (e.g., $\Delta z_c$) to a surface or position from which an extension extends. This distance may be less than the distance from the z-plane to the end of a conventional boreless or bored compressor wheel that does not have such an extension. For various exemplary compressor wheels, the ratio of $\Delta z_c$ to $\Delta z_{max}$ can vary, as appropriate, for example, to achieve a shift in the center of gravity away from the nose of the wheel.(e.g., in comparison to a wheel having a bore or conventional boreless design), etc. In various examples, a compressor wheel extension reduces the distance from the z-plane to an operational shaft of a turbocharger when compared to a conventional compressor wheel.

Figure 6:
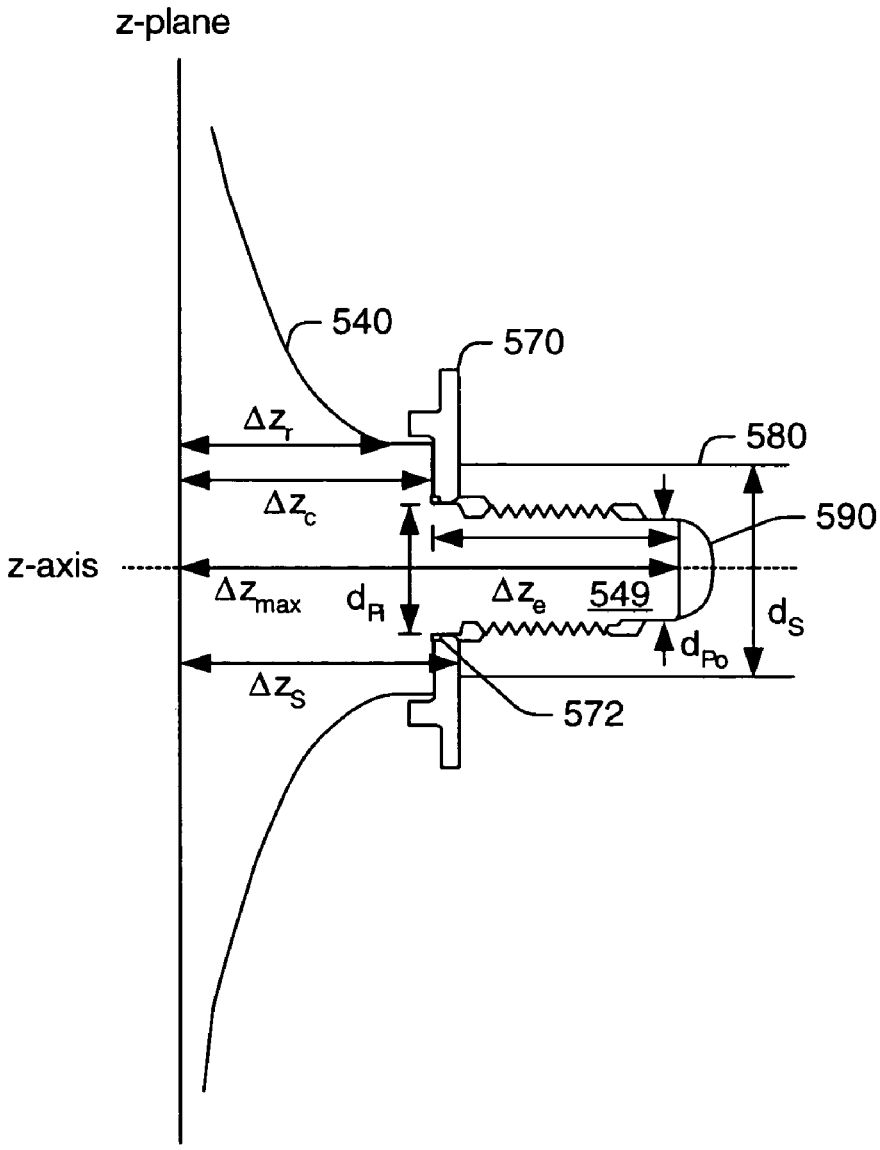
FIG. 6 is a cross-sectional view of the exemplary joint of FIG. 5.

FIG. 6 shows a cross-sectional view of an exemplary joint that includes a compressor wheel 540 and a shaft 580 such as those shown in FIG. 5. FIG. 6 shows various dimensions including a distance $\Delta z_r$ from the z-plane to a point where the exemplary wheel 540 reaches a substantially constant outer radius with respect to the z-axis; a distance $\Delta z_S$ from the z-plane to the outermost axial point of the exemplary shaft 580; a diameter $d_{Pi}$, which represents an inner pilot diameter of the extension 549; a distance $\Delta z_e$, which represents the axial length of the extension 549; a diameter $d_{Po}$, which represents an outer pilot diameter of the extension 549; and a diameter $d_S$, which represents a shaft diameter.

The exemplary shaft 580 includes a joint 590 to receive the extension 549. The example of FIG. 6 shows the joint 590 as including an optional contoured end surface. In general, the shaft 580 has a substantially constant outer diameter proximate the compressor wheel 540. A constant outer diameter acts to minimize stress of the shaft 580. Consequently, the presence of the joint 590 in the shaft 580 does not necessitate stress reduction measured or concerns such as those associated with a conventional boreless wheel where outer radius varies significantly along the z-axis.

Various exemplary compressor wheels allow for a reduced overhang length compared to conventional boreless compressor wheels. A reduction in overhang length may also allow for a reduction in overall length of a compressor section of, for example, a turbocharger and thereby yielding a stable rotor and turbocharger system.

In the example of FIG. 6, the exemplary compressor wheel 540 includes a first pilot diameter $d_{Pi}$ for alignment with the thrust collar 570 and a second pilot diameter $d_{Po}$ for alignment with a pilot surface of the joint 590 of the exemplary shaft 580. Disposed between the pilot surfaces are threads or other engagement mechanism or means (e.g., bayonet, etc.). The exemplary shaft 580 includes a corresponding or complimentary threads or engagement mechanism or means (e.g., bayonet, etc.).

An exemplary joint may be defined by one or more regions, volumes, surfaces and/or dimensions. For example, the exemplary joint 590 includes a proximate region (e.g., consider diameter $d_{Pi}$), an intermediate region (e.g., consider threads) and a distal region (e.g., consider diameter $d_{Po}$). Such regions may be referred to as pilot regions and/or co-pilot regions or threaded regions, as appropriate. An intermediate region or other region may include threads or other fixing mechanism (e.g., bayonet, etc.). Where threads are included, the threads typically match a set of threads of an exemplary compressor wheel.

An exemplary joint may include one or more annular constrictions, for example, disposed near a juncture between regions where the one or more annular constrictions decrease in diameter with respect to increasing length along the axis of rotation and may form a surface disposed at an angle with respect to the axis of rotation. A constriction may act to minimize or eliminate any damage created by machining (e.g., boring, taping, etc.).

Materials of construction for an exemplary compressor wheel are not limited to aluminum and titanium and may include stainless steel, etc. Materials of construction optionally include alloys. For example, Ti-6Al-4V (wt.-%), also known as Ti6-4, is alloy that includes titanium as well as aluminum and vanadium. Such alloy may have a duplex structure, where a main component is a hexagonal α-phase and a minor component is a cubic β-phase stabilized by vanadium. Implantation of other elements may enhance hardness (e.g., nitrogen implantation, etc.) as appropriate.

An exemplary compressor wheel may include, for component balancing, a balancing unit that cooperates with one or more features of the compressor wheel (e.g., extension features). For example, a balancing unit may include a joint such as the joint 590 of the exemplary shaft 580.

Figure 7:
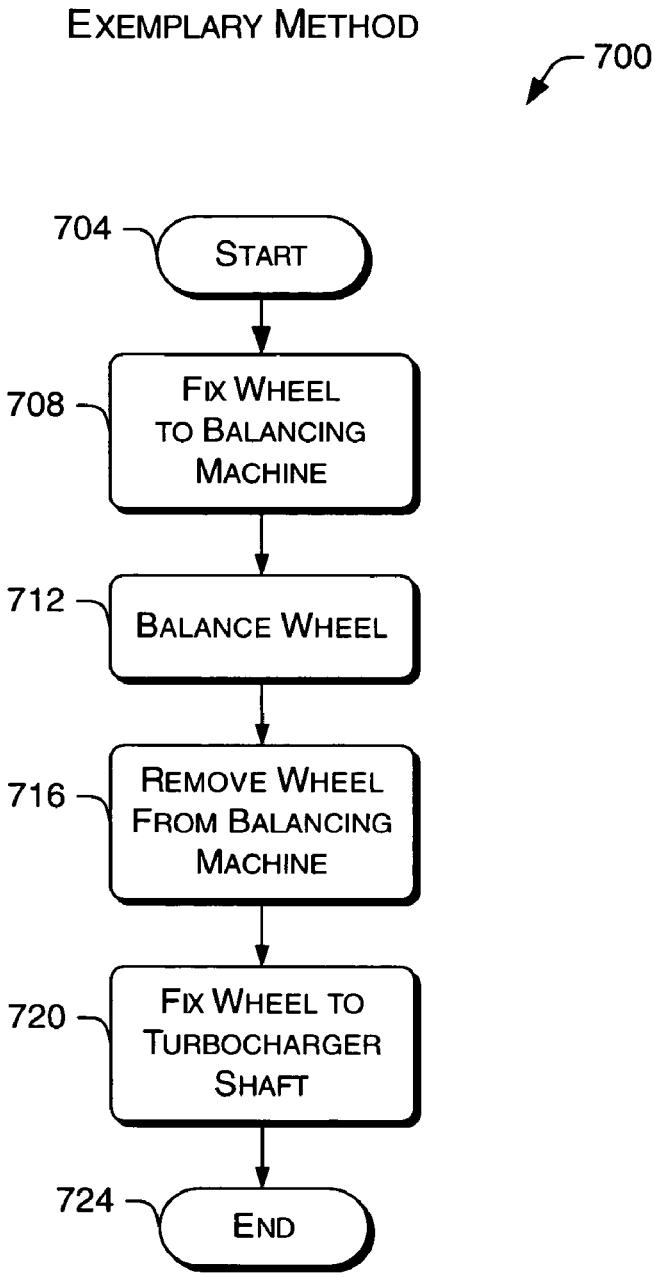
FIG. 7 is a block diagram of an exemplary method for balancing a compressor wheel.

FIG. 7 shows a block diagram of an exemplary method 700. The method 700 commences in a start block 704, which includes providing a compressor wheel and a balancing machine having a balancing unit. In a fixation block 708, the balancing unit receives an exemplary extension. For example, an operator may insert the extension, at least partially, into a joint of a balancing unit. Such a joint may include one or more pilot surfaces that receive one or more pilot surfaces of the extension.

A balance block 712 follows wherein a balancing process occurs. In general, balancing is dynamic balancing. After the balancing, in a removal block 716, the compressor wheel extension is removed from the joint of the balancing unit. Next, in another fixation block 720, an exemplary shaft receives the extension wherein other components are positioned or assembled as appropriate. The method 700 may terminate in an end block 724. The method 700 optionally includes another balancing block wherein the compressor wheel and operational shaft are balanced as an assembly. In an alternative, the exemplary shaft is used in a balancing process for an exemplary compressor wheel.

The exemplary method 700 and/or portions thereof are optionally performed using hardware and/or software. For example, the method and/or portions thereof may be performed using robotics and/or other computer controllable machinery.

As described herein such an exemplary method or steps thereof are optionally used to produce a balanced compressor wheel. Various exemplary compressor wheels disclosed herein include a proximate end, a distal end, an axis of rotation, a z-plane positioned between the proximate end and the distal end, and an extension having an axis coincident with the axis of rotation. An exemplary shaft includes a complimentary joint to receive the extension, at least partially therein. An exemplary shaft joint may include a contoured end surface optionally having an elliptical cross-section (e.g., radius to height ratio of approximately 3:1, etc.). An exemplary compressor wheel optionally includes titanium, titanium alloy (e.g., Ti6-4, etc.) or other material having same or similar mechanical properties. Such a compressor wheel optionally has a peak principle operational stress less than that of a conventional boreless compressor wheel. Various exemplary compressor wheels are optionally part of an assembly (e.g., a balancing assembly, a turbocharger assembly, a compressor assembly, etc.). An exemplary assembly includes an exemplary compressor wheel and an exemplary operational shaft.

Conclusion

Although some exemplary methods, devices, systems, etc., have been illustrated in the accompanying Drawings and described in the foregoing Description, it will be understood that the methods, devices, systems, etc., are not limited to the exemplary embodiments disclosed, but are capable of numerous rearrangements, modifications and substitutions without departing from the spirit set forth and defined by the following claims.

What is claimed is:

1. An assembly comprising:

an operational shaft of a turbocharger that comprises a joint wherein the joint comprises a pilot surface;

a unitary compressor wheel that comprises a proximate end;

a distal end;

an axis of rotation;

a z-plane positioned between the proximate end and the distal end; and a proximate end extension wherein the extension comprises a thrust collar pilot diameter, a joint pilot diameter and an engagement mechanism disposed between the thrust collar pilot diameter and the joint pilot diameter, the joint pilot diameter configured for alignment with the pilot surface of the joint and the engagement mechanism configured for engagement with the joint; and a thrust collar, disposed between the compressor wheel and the shaft, that comprises a pilot surface configured for alignment with the thrust collar pilot diameter of the extension;

wherein the assembly comprises an axial dimension $\Delta z_{max}$ measured from the z-plane to a tip of the extension, an axial dimension $\Delta z_S$ measured from the z-plane to an end of the shaft, and an axial dimension $\Delta z_C$ measured from the z-plane to a compressor wheel side annular face of the thrust collar, wherein $\Delta z_C<\Delta z_S<\Delta z_{max}$, wherein the difference between $\Delta z_C$ and $\Delta z_S$ is determined by an axial thickness of the thrust collar and wherein the thrust collar pilot diameter is disposed between the axial dimensions $\Delta z_C$ and $\Delta z_S$ and is larger than the joint pilot diameter.

2. The assembly of claim 1 wherein the proximate end of the wheel comprises an annular surface in a plane, the axis of rotation substantially normal to the plane.

3. The assembly of claim 2 wherein the thrust collar comprises an annular surface capable of seating against the annular surface of the proximate end of the compressor wheel.

4. The assembly of claim 1 further comprising a ring disposed between the thrust collar and the compressor wheel.

5. The assembly of claim 1 wherein the engagement mechanism comprises threads.

6. The assembly of claim 1 wherein the extension engages the operational shaft of a turbocharger to a depth determined in part by a thickness of the thrust collar.

7. A turbocharger assembly comprising:

a shaft having an axis of rotation and a joint that comprises a pilot surface;

a unitary compressor wheel wherein the compressor wheel comprises a proximate end, a distal end, an axis of rotation coincident with the axis of the shaft, a z-plane positioned between the proximate end and the distal end and a proximate end extension that extends into the joint of the shaft wherein the extension comprises a thrust collar pilot diameter and a joint pilot diameter; and a thrust collar disposed between a surface of the compressor wheel, that meets the thrust collar, and a surface of the shaft wherein the thrust collar comprises a pilot surface configured for alignment with the thrust collar pilot diameter of the extension;

wherein the assembly comprises an axial dimension $\Delta z_{max}$ measured from the z-plane to a tip of the extension, an axial dimension $\Delta z_S$ measured from the z-plane to an end of the shaft, and an axial dimension $\Delta z_C$ measured from the z-plane to the surface of the compressor wheel that meets the thrust collar, wherein $\Delta z_C <\Delta z_{S <\Delta zmax}$, wherein the difference between $\Delta z_C$ and $\Delta z_S$ is determined by an axial thickness of the thrust collar and wherein the thrust collar pilot diameter is disposed between the axial dimensions $\Delta z_C$ and $\Delta z_S$ and is larger than the joint pilot diameter.

8. The turbocharger assembly of claim 7 wherein the extension comprises an engagement mechanism for engagement with the shaft.

9. The turbocharger assembly of claim 7 wherein an axial thickness of the thrust collar determines in part the depth of the extension of the compressor wheel in the joint of the shaft.

10. The turbocharger assembly of claim 7 wherein an axial thickness of the thrust collar and a thickness of a ring determine in part the depth of the extension of the compressor wheel in the joint of the shaft.

11. A method for balancing a unitary compressor wheel comprising:

inserting an extension of the compressor wheel into a joint of a balancing unit wherein the extension comprises one or more pilot surfaces, wherein the joint comprises one or more pilot surfaces and wherein at least one pilot surface of the joint cooperates with a respective pilot surface of the extension of the compressor wheel;

balancing the compressor wheel;

removing the compressor wheel from the joint;

inserting the extension of the compressor wheel into a thrust collar wherein the thrust collar comprises a pilot surface that cooperates with a respective pilot surface of the extension of the compressor wheel; and inserting the extension of the compressor wheel into a joint of a turbocharger shaft to form an assembly wherein the compressor wheel comprises a z-plane and wherein the assembly comprises an axial dimension $\Delta z_{max}$ measured from the z-plane to a tip of the extension, an axial dimension $\Delta z_S$ measured from the z-plane to an end of the shaft, and an axial dimension $\Delta z_C$ measured from the z-plane to a surface of the thrust collar seated adjacent the compressor wheel, wherein $\Delta z_C <\Delta z_S <\Delta z_{max}$, wherein the difference between $\Delta z_C$ and $\Delta z_S$ is determined by an axial thickness of the thrust collar and wherein, for the extension, its respective pilot surface for the thrust collar is disposed between the axial dimensions $\Delta z_C$ and $\Delta z_S$ and is larger in diameter than its respective pilot surface for the joint.

* * * * *